United States Patent [19]

Brooks

[11] 4,007,552

[45] Feb. 15, 1977

[54] EXTRUDED ALUMINUM SIGN FRAME SYSTEM

[75] Inventor: Jackson R. Brooks, Fort Collins, Colo.

[73] Assignee: ABC Extrusion Company, Fort Collins, Colo.

[22] Filed: Sept. 4, 1973

[21] Appl. No.: 393,927

[52] U.S. Cl. ..... 40/130 R; 40/125 R; 40/132 R; 52/656

[51] Int. Cl.[2] ..... G09F 7/18

[58] Field of Search ..... 40/130 R, 132 R, 132 D, 40/125 R, 125 H, 140, 142, 125 K, 156; 52/656

[56] References Cited

UNITED STATES PATENTS

| | | | |
|---|---|---|---|
| 1,219,236 | 3/1917 | Brewster | 40/206 |
| 3,235,989 | 2/1966 | Brooks | 40/130 R |
| 3,390,259 | 6/1968 | Angier | 40/130 R X |
| 3,391,481 | 7/1968 | Lloyd | 40/130 R |
| 3,593,447 | 7/1971 | Winegarten | 40/130 R |
| 3,593,448 | 7/1971 | Schoepf et al. | 40/132 D |
| 3,722,119 | 3/1973 | Braun | 40/132 D |
| 3,835,613 | 9/1974 | Davies | 40/130 R X |

FOREIGN PATENTS OR APPLICATIONS

| | | | |
|---|---|---|---|
| 909,506 | 9/1972 | Canada | 40/132 R |

*Primary Examiner*—John F. Pitrelli
*Attorney, Agent, or Firm*—Hugh H. Drake

[57] ABSTRACT

A sign frame assembly is used for constructing peripheral display panel supporting frames for internally illuminated or other type signs. The system employs three basic extruded shapes — a generally channel-shaped main frame member, a snap-fitting cover member for mounting on the main frame member to provide an enclosed watertight wiring chamber, and a retainer member for mounting a sign display panel upon the main frame member. The basic shapes are designed for rapid assembly and to provide convenient access to the interior of the assembled frame and sign. Alternate retainer member shapes enable the display panel to be either peripherally clamped to the main frame or to be hingedly mounted upon the main frame, so that access to the sign interior may be had without completely removing the display panel. The main and cover frame members are constructed in two or more standardized sizes while a single size of retainer member is usable with all of the various sizes of main frame members. The three basic shapes are equally well adapted to the construction of either single or double faced signs.

19 Claims, 6 Drawing Figures

EXTRUDED ALUMINUM SIGN FRAME SYSTEM

BACKGROUND OF THE INVENTION

The present invention is especially directed to the solution of various problems encountered by sign manufacturers in the construction and maintenance of internally illuminated and similar signs. Signs of this type are widely employed and their construction constitutes a substantial portion of the business of most sign manufacturers. Signs of the type with which the present invention is concerned often take the form of a relatively narrow hollow box in which one (single faced) or both (double faced) of the major sides are formed by translucent sign display panels. Fluorescent tubes mounted within the interior of the sign are employed to back light the display panels. Because the display panels possess little structural strength, the panels are mounted in a peripheral frame which supplies the necessary structural strength for the sign, provides a support for in the fluorescent tubes and also provides an enclosure for the electrical wiring and other components of the illumination system. The present invention is especially directed to the frame assembly of such signs.

Extruded aluminum shapes are quite commonly employed in the construction of sign frames of the type under consideration — see, for example, my previously issued U.S. Pat. No. 3,235,989. While literally thousands of extruded aluminum shapes are available to the sign industry, the very fact that such a large number of shapes are available is evidence of a continuing search in the industry for improvements in this field. This, in turn, indicates a lack of satisfaction with presently available designs.

The present invention is especially designed to overcome some of the problems most commonly encountered by prior art sign frame constructions. With an inventory of a small number of standardized shapes according to the present invention, a manufacturer is able to construct rectangular or polygonal signs of a wide range of sizes, of single or double face construction, and in which a display panel may be detachably clamped in place or hingedly mounted. The present invention also enables the construction of a sign in a manner such that the interior of the sign is readily accessible for cleaning, replacement of burned out lights or for maintenance and repair of the electrical power system. By minimizing the number of stock parts required to maintain an adequate inventory for custom sign construction, the sign manufacturer is able to order individual parts in relatively large quantities, thus obtaining a volume discount. Further cost reductions are achieved by the design of the individual shapes in a manner such that, in assembly, the assembled parts cooperatively strengthen each other and enable the employment of lighter and, hence, less expensive extrusions.

SUMMARY OF THE INVENTION

The sign frame assembly of the present invention is constructed from three basic members — a main frame member, a cover member, and a retainer member. Each of these frame members preferably is in the form of an aluminum extrusion, and the configuration of the extrusions is such that the present invention is limited in application to signs of rectangular or polygonal shape. Their construction forecloses the possibility of being bent.

The main frame member is of generally channel-shaped cross-sectional configuration, the bottom of the channel being defined by a flat main panel. Integral side webs project upwardly from the opposite longitudinal side edges of the main panel and are each formed with flat display panel engaging webs terminating at their outer ends in inwardly offset hanger bar shelves engageable with a display panel hanger bar to locate and suspend the display panel. A groove along the inner side of the hanger bar shelf is provided to receive a tongue on the display panel hanger bar if it is desired to employ this method of locking the panel in place. At the outer end of each side web, a support flange projects inwardly from the side web into overlying relationship with the main panel. The support flanges are formed with longitudinally extending outwardly opening recesses which are undercut to receive complementally shaped ribs projecting inwardly from the inner side of a generally flat cover member. The recesses and ribs are so spaced that a snap fit is obtained between the cover member and main frame member to retain mechanically the cover member in a water-tight assembled relationship to the main frame member. The assembled cover member and main frame member define a hollow tubular chamber which, in the assembled sign, is employed as a wiring chamber and enclosure for other components of the illumination system such as the ballast(s) for the fluorescent lighting system. The configuration of one mating set of ribs and recesses is such that the cover member may be hinged relative to the main frame member for access to the wiring chamber without disassembly. Alternatively, the cover may be removed in its entirety.

The recesses in the support flanges are spaced transversely inwardly from the outer edges of the support flanges, and one web of a retainer member is seated upon and supported by the outer portion of each support web. The retainer member includes a first web, seated on the support web of main frame member, and a second web having a display panel engaging portion which is located to be in space-opposed relationship with the display panel engaging web of the main frame member when the retainer member is assembled upon the main frame member. The panel engaging portion of the second web of the retainer is of U-shaped transverse cross section, one leg of the U being engageable with the display panel so that a tongue type hanger bar on the display panel may be seated within the recess of the U-shaped portion, this arrangement being employed when the hinging type retainer bar is used.

In those installations where the display panel is clamped into position, the retainer member is mounted by screws passing through its first web and the support flange of the main frame member. Where a hinged display panel is desired, an alternate form of retainer member is employed which has a hinge rib of bulbous transverse cross section extending along the inner edge of the first web of the retainer member. The main frame member is formed with two hinged grooves extending along one of its support flanges, the first hinged groove being employed for the cover member hinge rib and the second hinged groove receiving the hinge rib of the hinging type retainer. The recessed grooves also serve to help carry off water in satisfaction of safety requirements.

For all except exceptional cases, an adequate inventory can be obtained by stocking two standardized sizes of main frame members and cover members, a single size of retainer member being usable with either. The two frame sizes differ primarily in the transverse width of the main frame and cover member, the wider sides requiring a somewhat thicker wall thickness. For extremely large signs, divider bars may be employed. Thus, a complete inventory from which frames for substantially all rectangular or polygonal signs of normally requested dimensions can be made is established by stocking adequate supplies of but seven different parts. Alternatively, another retainer member may also be stocked so as to accommodate thicker faces.

Other objects and features of the invention will become apparent by reference to the following specification and to the drawings.

IN THE DRAWINGS

Figure 1:
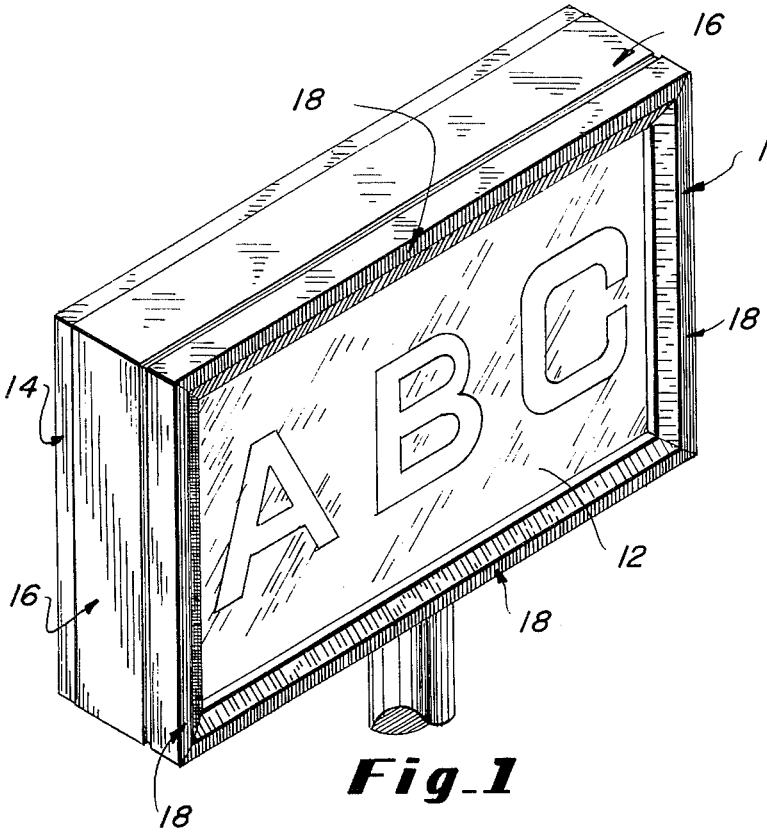
FIG. 1 is a perspective view of an internally illuminated sign embodying the present invention.

Referring briefly to FIG. 1, there is shown a typical sign constructed in accordance with the present invention. In general, the sign includes a peripheral frame, designated generally 10, to which the present invention is directed and within which is mounted a translucent display panel 12. Conventionally, as such, the display panel is back lighted by fluorescent tubes mounted from frame 10, the wiring and other electrical components of the illumination system being mounted within frame 10.

Figure 2:
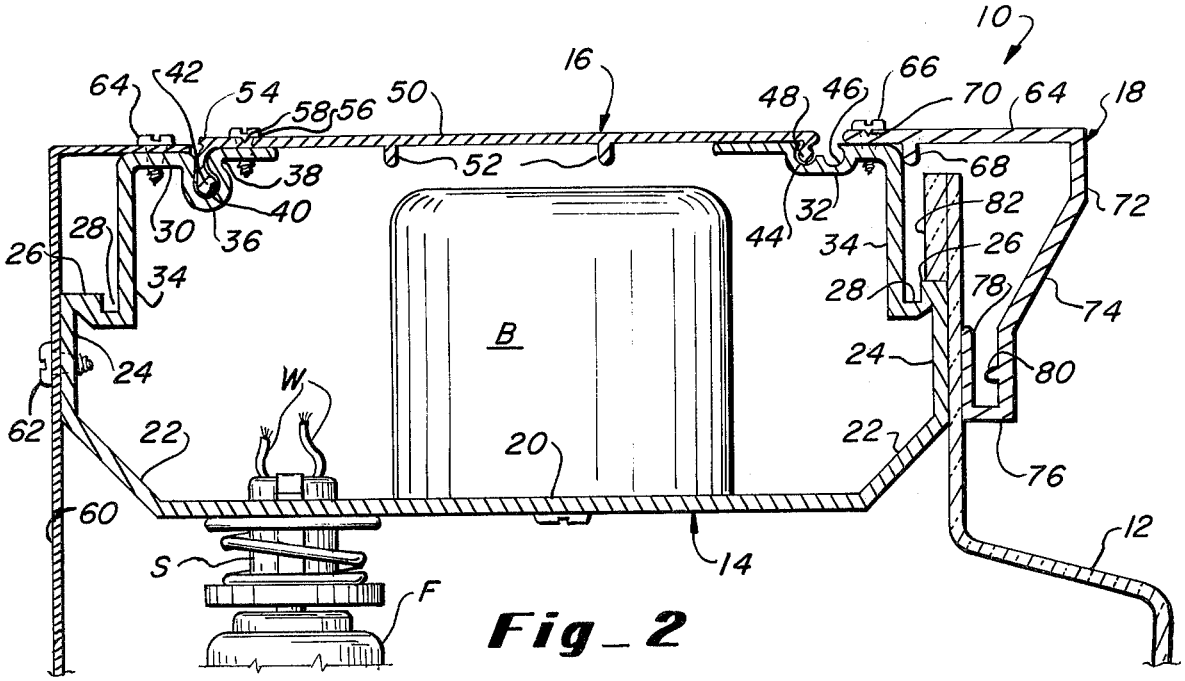
FIG. 2 is a detailed transverse cross-sectional view of a portion of a sign frame embodying the present invention.

Referring now to FIG. 2, one form of frame assembly 10 embodying the present invention is shown in transverse cross section. The particular form of the invention shown in FIG. 2 shows a construction for a single-face sign having a single display panel 12. As seen in FIG. 2, the sign frame is made up from three basic members, a main frame member designated generally 14, a cover member 16, and a retainer member 18.

Main frame member 14 takes the form of an aluminum extrusion having a main panel 20 which is flat and integrally joined at its opposite longitudinal edges to inclined web sections 22 which project upwardly and outwardly at an angle of 45° to the general plane of main panel 20. That incline permits light to spill out to the panel edge. Integrally formed at the outer edges of each of inclined panels 22 are display panel engaging webs 24 which lie in respective planes perpendicular to that of main panel 20. At the upper end of each web 24 as viewed in FIG. 2, an inwardly projecting hanger bar shelf 26 is formed, each shelf 26 having an upwardly opening recessed groove 28 extending along its inner edge. Inwardly projecting support flanges 30 and 32 are integrally joined to hanger bar shelves 26 by side web extensions 34, support flanges 30 and 32 projecting inwardly into overlying relationship with main panel 14. Apart from support flanges 30 and 32, main frame member 14 is symmetrical about a vertical longitudinal plane perpendicular to the cross-sectional plane of FIG. 2. It will be observed that shelf 26 permits use of a universal form of retainer 18.

Support flange 30 is formed with a relatively deep recess 36, the inner side wall of recess 36 being convex adjacent to the recess mouth as at 38 and the convex section 38 merging into a concave section 40 which provides a smoothly curved undercut recess adapted to receive and retain a latching rib 42 of complementary configuration integrally formed on cover member 16. Section 38 is positioned above the remainder of flange 30 so as to provide a drainage block.

The opposite support flange 32 is formed with a pair of somewhat smaller recesses 44 and 46, recesses 44 and 46 being shaped with oppositely disposed rounded undercut recesses. A downwardly projecting rib 48 formed on the opposite longitudinal edge of cover member 16 is formed with a configuration complementary to that of recess 44, rib 48 and recess 44 being so configured as to constitute a hinge by means of which cover 16 can be pivoted relative to main frame member 14 when rib 42 is disengaged from recess 36. Alternatively, the panel may be removed in its entirety.

Like main frame member 14, cover member 16 desirably is an aluminum extrusion in the form of a generally flat plate 50 having ribs 42 and 48 integrally formed and projecting inwardly from its opposite longitudinal side edges. However, cover member 16 may instead be formed of sheet metal to reduce cost. Preferably, stiffening ribs 52 are formed at suitable locations on the interior surface of plate 50, and a projecting lip 54 at the base of rib 42 provides a purchase for a screwdriver blade to assist in disengaging rib 42 from recess 36.

The spacings between recesses 36 and 44 and between ribs 42 and 48 are established to provide a reasonably firm snap fit of cover member 16 to main frame member 14. When assembled, main frame member 14 and cover member 16 cooperatively define a hollow tubular chamber which provides a substantially weather tight housing for the wiring system W and ballast B employed in conjunction with fluorescent lighting tubes F employed to back light display panel 12. Moreover, the chamber is sufficiently large to accommodate alternative components such as transformers for use with the neon tubes of that type of display panel assembly. As indicated in FIG. 2, the sockets S for fluorescent tubes F are conveniently mounted in a conventional manner at appropriate locations on main panel 20. Cover member 16 preferably is secured in its closed position by a series of screws such as 56, the undercut of recess 44 on the opposite support flange being such that rib 48 cannot be disengaged from recess 44 unless cover member 16 is pivoted to an approximate 30° position. On the other hand, the cover will not disengage when fully open. Grooves 58 in cover 16 serve as a drill guide during construction. When desired, a safety chain may be connected between the cover and the main frame so as to guard against displacement during servicing.

The cross-sectional view of FIG. 2 is one taken on a vertical plane through the top side of a rectangular sign of single face construction. Because of the single face construction, a single retainer member 18 is employed along each side of the frame, the rear on nondisplay side of the sign in this instance being closed by a sheet metal panel 60 secured to main frame 14 as by screws 62 and 64.

Like main frame member 14 and cover member 16, retainer member 18 is an extruded aluminum shape having a first web 64 adapted to overlie and to be secured to that portion of support flange 32 which is not covered by cover member 16. Screws 66 are employed to secure retainer member 18 to support flange 32. A locating rib 68 projects inwardly from the inner side of web 64 to transversely locate retainer member 18 relative to main frame member 14, and a locating groove 70 is formed in the outer surface of web 64 to assist in drilling the screw receiving hole. Rib 68 and groove 70 constitute a worthwhile labor-saving feature. Retainer member 18 includes a second web 72 integral with web 64 and projecting generally at right angles to web 64. To achieve a picture frame effect in the assembled sign, web 72 includes an angularly offset panel 74 for the purpose of giving a beveled effect to the completed sign. A generally U-shaped panel-engaging portion is formed along the distal edge of web 72, the innermost leg 78 of U-shaped portion 76 being located in space-opposed relationship to the panel engaging web 24 of main frame 10 when retainer member 18 is assembled upon the main frame to clampingly secure display panel 12 in position relative to the frame. A locating lip 80 projects inwardly from the opposite leg of portion 76 for purposes to be described below.

Display panels 12 are normally constructed of a relatively thin plastic material, such as Plexiglas or other acrylic, and, particularly in the case of signs where the display panel is of substantial height, it is customary to secure a hanger bar strip 82 to the upper edge of the display panel. Hanger bar strip 82 may be simply a strip of plastic material adhesively secured along the upper edge of the display panel and is supported by hanger bar shelf 26 so that the upper edge of the display panel will not sag. The hanger bar also controls expansion and contraction of the panel within the frame.

In the construction of FIG. 2, a rectangular sign frame is assembled by fixing four main frame members 14 to each other in a desired rectangular relationship as by welding along the abutted edges or by securing the adjacent members to each other by brackets. The display panel is held in place by bolting the four retainer members 18 to the corresponding main frame members 14 to hold the panel in position. In this arrangement, access to the interior of the sign, as to change fluorescent tubes F, is usually achieved by removing one of the retainer members 18 extending along a vertical side of the frame assembly and sliding the panel 12 clear of the frame assembly to expose the sign interior; hanger bar strips 82 are located only along the top edge of the sign. Alternatively, hand holes may be located in interior wall 20 as to permit access for changing tubes, cleaning and so forth.

Figure 3:
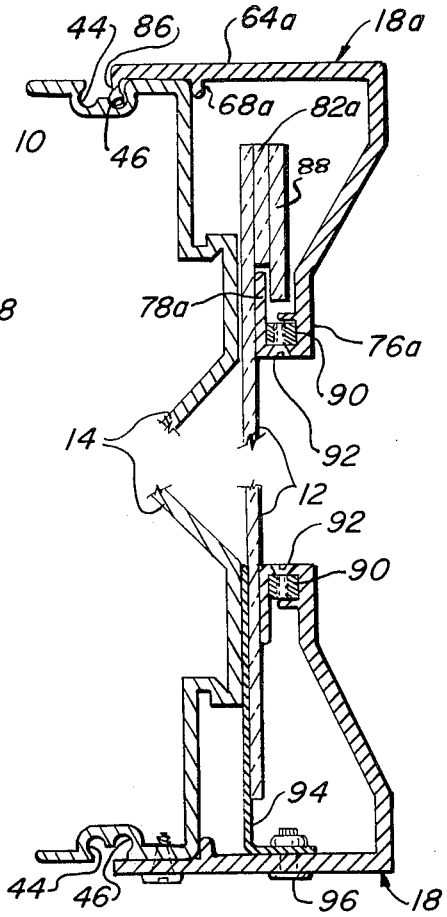
FIG. 3 is a partial cross-sectional view through a sign constructed in accordance with the present invention, showing a modification of the construction of FIG. 2.

In FIG. 3, an alternative form of construction is disclosed in which the display panel 12 is hingedly mounted along the upper edge of the sign frame assembly by a modified form of retainer member 18*a*. Retainer member 18*a* differs from retainer member 18 in that a downwardly projecting hinge rib 86 of generally bulb-shaped transverse cross-section is formed along the inner edge of first web 64*a*. As shown in FIG. 3, hinge rib 86 is received within the outer recess 46 of main frame member 14 to constitute a hinged connection between main frame member 14 and retainer member 18*a*.

Where the hinged display panel mounting is employed, a hanger bar 82*a* is fixedly secured along the upper edge of display panel 12 on the front or outer side of display panel 12, and a downwardly projecting retainer tongue 88 is secured to the front or outer surface of the hanger bar. With this arrangement, hanger bar 82*a* is supported upon the lip of leg 78*a* of the U-shaped portion 76*a* of retainer 18*a*, while tongue 88 projects downwardly between the leg of U-shaped portion 76*a* to lock the display panel mechanically to retainer member 18*a*.

Figure 4:
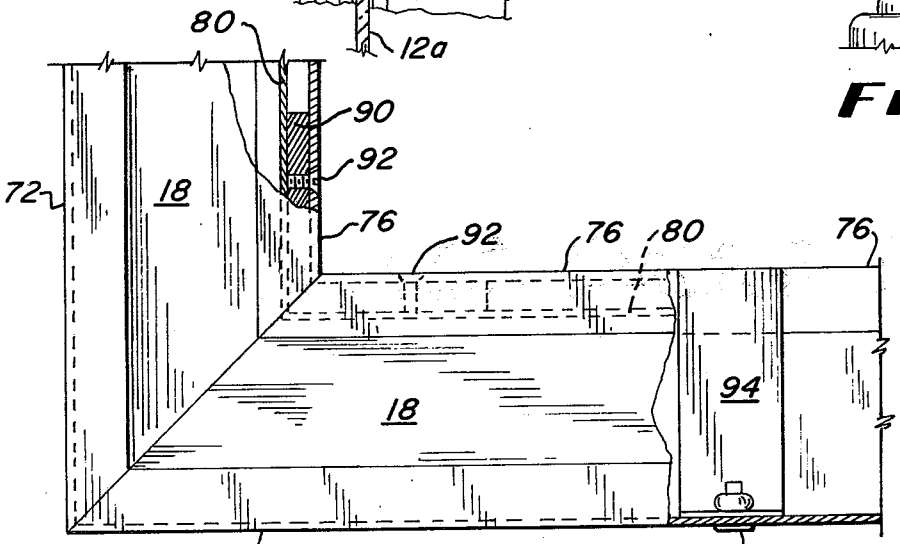
FIG. 4 is a detail front view, with certain parts broken away or shown in section, of a corner of the frame of a sign embodying the present invention.

Because, the FIG. 3 embodiment, the entire display panel 12 must hinge outwardly with retainer member 18*a*, retainer members 18, extending along the remaining two vertical and bottom sides of the frame assembly, are secured to each other as by angle brackets 90 (see also FIG. 4) held in place at the bottom of U-shaped portion 76, 76*a* as by screws 92. Angle brackets 90 are located by locating lips 80. Panel 12 is retained in position relative to the three retainer members 18 by a series of right-angled sheet metal clips 94 riveted to retainer members 18 as by rivets 96.

Figure 5:
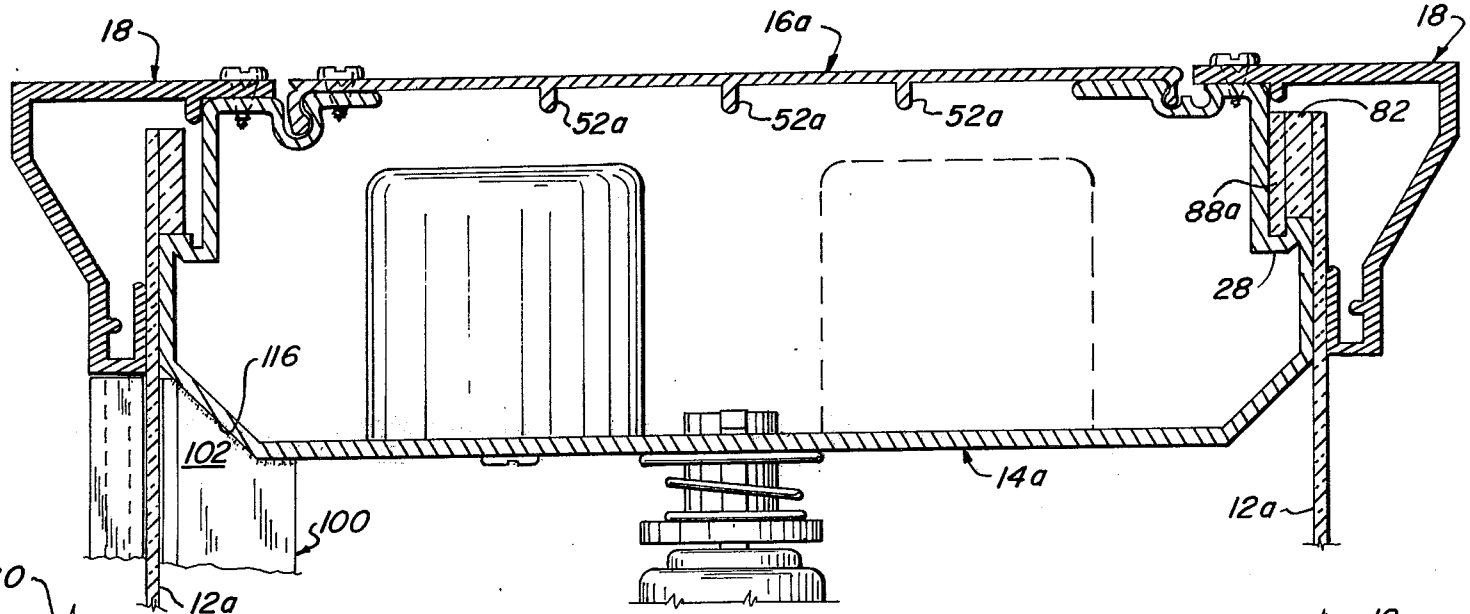
FIG. 5 is a detailed transverse cross-sectional view showing a modified form of sign frame assembly.

A modified form of frame assembly is shown in cross-section in FIG. 5 in a double-face sign environment. Main frame members 14*a* and cover members 16*a* differ from main frame member 14 and cover member 16 of FIG. 2 primarily in that members 14*a* and 16*a* have a transverse width greater than the corresponding dimensions of members 14 and 16. In practice, main frame member 14 is approximately 8 inches in width (the dimension between the outer side surfaces of panel engaging web 24), while main frame member 14*a* is formed with a width of approximately 12 inches. These two sizes have been found adequate to construct substantially all signs within the normally encountered size range.

Because of the increased transversed dimension, cover member 16*a* is formed with three stiffening ribs 52*a* as opposed to the two corresponding ribs 52 of cover member 16. The web thickness of cover member 14*a* is slightly increased over that of main frame members 14. Retainer members 18 (or 18*a*) employed in conjunction with the larger frame member 14*a* are of the same size and configuration as those employed with the smaller main frame member 14. FIG. 5 also depicts a modified form of display panel mounting in which a retainer tongue 88*a* is secured to hanger bar 82 to project downwardly so as to seat in groove 28 in the hanger bar shelf. Thus, the display face is captivated even upon removal of the retainer. Thus, groove 28 enables the locking of the panel into place so that it is safely situated even though the retainer may be removed during servicing.

Figure 6:
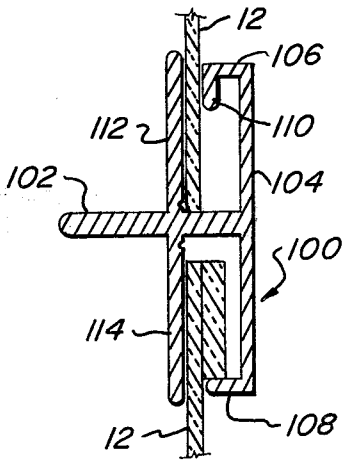
FIG. 6 is a cross-sectional view of a divider bar.

In those cases where the display panel area is quite large, one or more divider bars 100, such as that shown in cross section in FIG. 6, may be employed so that the area of the display face can be made up in two or more separate panels. The divider bar is an extruded aluminum shape which includes a horizontally disposed main web 102 having an integral vertically disposed outer web 104 joined approximately midway of its height to one end of main web 102. Inwardly projecting upper and lower flanges 106, 108 extend along the upper and lower edges of vertical web 104, a downturned tongue 110 being formed along the inner edge of upper flange 106. Vertically extending retaining flanges 112 and 114 project upwardly and downwardly from main web 102 in inwardly spaced relationship to flanges 106 and 108 to form a retaining slot within which the edges of display panels 12 may be received and retained. Where used, the divider bars are welded to the main frame members as at 116, see left hand side of FIG. 5, in a well known manner.

While the structural arrangements have now been presented in sufficient detail to enable reproduction, a number of features are worthy of further emphasis or additional explanation. Although not readily discernable in the drawings, the portion of member 18 which extends toward cover 16 preferably increases in thickness from its outer edge toward the cover. Such cantilever design provides a progressive strength increase. At the same time, rib 68 serves as a stop which is against the frame particularly when used with the one-eighth or three-sixteenth inch faces that constitute perhaps 90 percent of typical usage. This facilitates part location for fastening and helps prevent upward gyration of the retainer when stressed.

Leg 78 desirably has as much as three-fourths inch of contact length with the display face so as to spread stress and minimize discoloration of the typically plastic face by reason of movement against the aluminum frame. Opposite leg 78, lip 80 serves as a stop for corner angles during drilling and tapping, preventing movement of the angles.

It will be noted that hanger bar shelves 26 are placed on the main frame. This enables better performance, it being imperative that the hanger bar be dead level.

Generally, the entire structure is relatively light. Yet, it permits substantial face retention, such as 2¼ inches, the retention member being universal for all kinds of faces, sizes and configurations. This contributes to inventory reduction. At the same time, the entire assembly features a smooth, plain appearance that tends to be acceptable to architects, designers and purchasers.

It may be noted that all frame configurations permit exterior access, regardless of whether used in single-face, double-face or tandem-frame modes. Inclined panels 22 allow the light to spill out and fill the entire face opening. In practice, the available internal dimensions permit ample ballast space and accept, for example, up to a 7-inch mounting pole fastened entirely by internal plates and angles secured to the flat web.

While various embodiments of the invention have been described, it will be apparent to those skilled in the art that the disclosed embodiments may be modified. Therefore, the foregoing description is to be considered exemplary rather than limiting and the true scope of the invention is that defined in the following claims.

I claim:

1. A sign frame assembly for constructing a hollow peripheral frame that supports a sign display panel comprising:

an extruded main frame member having a generally flat main panel;

a pair of opposed side webs integral with said main panel and extending along the opposite side edges thereof;

cover support flanges, integral with each of said side webs, extending along the edge of each side web remote from said main panel and projecting from the respective side webs into spaced overlying parallel relationship with said main panel;

a generally flat cover member adapted to span the space between said support flanges;

longitudinally extending rib means on said cover member projecting from the interior side of said cover member along the opposite side edges thereof;

said support flanges of said main frame member having longitudinally extending rib receiving recesses therein located to receive said ribs to releasably clamp said cover member to said main frame member and cooperatively define a closed hollow tubular structure;

and an extruded retainer member having a first web adapted to lie in face-to-face engagement with one of said support flanges, alignment means on said first web for locating said retainer member upon said main frame member and a second web on said retainer member having a portion disposed in perpendicular relationship to said first web and adapted to clamp a sign display panel against the exterior side of said side web.

2. A sign frame assembly as defined in claim wherein the interior side wall of each recess remote from said side web has a convexly curved surface adjacent the mouth of said recess merging into a concavely curved surface adjacent the bottom of said recess to define an undercut recess side wall, the opposed facing surfaces of said ribs having curved surfaces complementary to said curved surfaces of said recess, the transverse spacing between said recesses and between said ribs being related to each other to provide a tight snap fit between said cover member and said main frame member when said ribs are seated in said recesses.

3. A sign frame assembly as defined in claim 2 wherein the concavely curved surface of one of said recesses is of constant radius, the complementary portion of the surface of the rib received in the last-mentioned recess having a constant radius bulb-shaped enlargement extending along the free edge of said rib to constitute a hinge connection between said cover member and said main frame member.

4. A sign frame assembly as defined in claim 3 in which said one recess is undercut in an amount requiring tilting of said cover member away from said main frame member prior to disengagement of said cover member from said main frame member.

5. A sign frame assembly as defined in claim 1 in which said alignment means is a lip projecting inwardly from said first web in a position to abut against said side web.

6. A sign frame assembly for constructing a hollow peripheral frame that supports a sign display panel comprising:

an extruded main frame member having a generally flat main panel;

a pair of opposed side webs integral with said main panel and extending along the opposite side edges thereof;

cover support flanges, integral with each of said side webs, extending along the edge of each side web remote from said main panel and projecting from the respective side webs into spaced overlying parallel relationship with said main panel;

a generally flat cover member that spans the space between said support flanges;

means for releasably securing said cover member to said support flanges;

and an extruded retainer member having a first web adapted to lie in face-to-face engagement with one of said support flanges, alignment means on said first web for locating said retainer member upon said main frame member and a second web on said retainer member having a portion disposed in perpendicular relationship to said first web and adapted to clamp a sign display panel against the exterior side of said side web.

7. A sign frame assembly as defined in claim 6 which further includes an inwardly projecting hinge rib of bulbous transverse cross section extending along one edge of said first web of said retainer member, one of said support flanges having a longitudinally extending hinge rib receiving recess therein adapted to receive said hinge rib and hingedly couple said retainer member to said main frame member.

8. A sign frame assembly as defined in claim 7 in which said retainer member is longitudinally segmented among different sides of said sign and which further includes means for securing together adjacent ones of the segments constituting said different sides.

9. A sign frame assembly as defined in claim 6 wherein said portion of said second web of said retainer member is of a generally U-shaped transverse cross-section, the recess of said U-shaped portion opening toward said first web of said retainer member.

10. A sign frame assembly as defined in claim 9 in which said retainer member is longitudinally segmented among different sides of said sign and which further includes angle brackets disposed in respective ones of said U-shaped portions being adjacent ones of the segments constituting said different sides.

11. A sign frame assembly as defined in claim 10 which further includes a lip projecting from said retainer member inwardly into said U-shaped portion and in a position determinative of the location of said brackets.

12. An assembly as defined in claim 6 in which the side web of said one support flange includes means defining a shelf engageable with a portion of the perimeter of said sign display panel.

13. A sign frame assembly as defined in claim 6 in which said main frame member includes means defining a hanger bar shelf, for said display panel, that extends along the edge of said panel so as to be enclosed by said retainer member.

14. A sign frame assembly as defined in claim 6 in which said cover member includes a longitudinally-extending exterior groove aligned over a mating portion of a corresponding one of said support flanges, said groove forming a part of said securing means.

15. A sign frame assembly as defined in claim 6 in which a portion of each of said support flanges, disposed inwardly from the corresponding side web beyond said securing means, is spaced from said main panel a distance greater than the remainder of the support flange.

16. A sign frame assembly as defined in claim 6 in which said first web increases in thickness in a direction from said second web toward said securing means.

17. A sign frame assembly for constructing a hollow peripheral frame that supports a sign display panel comprising:

an extruded main frame member having a generally flat main panel;

a pair of opposed side webs integral with said main panel and extending along the opposite side edges thereof;

cover support flanges, integral with each of said side webs, extending along the edge of each side web remote from said main panel and projecting from the respective side webs into spaced overlying parallel relationship with said main panel;

a generally flat cover member that spans the space between said support flanges;

means for releasably securing said cover member to said support flanges;

an extruded retainer member having a first web adapted to lie in face-to-face engagement with one of said support flanges, alignment means on said first web for locating said retainer member upon said main frame member and a second web on said retainer member having a portion disposed in perpendicular relationship to said first web and adapted to clamp a sign display panel against the exterior side of said side web; and said side webs comprising a flat display panel engaging web normal to said main panel and which includes means defining an inwardly offset hanger bar shelf extending along the edges of said panel engaging web adjacent to the cover support flange, said hanger bar support shelf being located intermediate said main panel and said support flange.

18. A sign frame assembly as defined in claim 17 which further includes a web section integrally joining said display panel engaging web to said main panel, said web section extending along the longitudinal side edge of said main panel and being inclined at an angle of the order of 45° to said main panel and said panel engaging web.

19. A sign frame assembly as described in claim 17 wherein said hanger bar shelf has a recessed longitudinally extending groove spaced inwardly of said shelf from said panel engaging web.

* * * * *